US012115459B1

(12) United States Patent
Karimi

(10) Patent No.: US 12,115,459 B1
(45) Date of Patent: Oct. 15, 2024

(54) MATH SOLVING BOARD GAME APPARATUS, SYSTEM, METHOD AND/OR COMPUTER PROGRAM PRODUCT

(71) Applicant: Kasra Karimi, Oakton, VA (US)

(72) Inventor: Kasra Karimi, Oakton, VA (US)

(73) Assignee: Kasra Karimi, Oakton, VA (US)

( * ) Notice: Subject to any disclaimer, the term of this patent is extended or adjusted under 35 U.S.C. 154(b) by 0 days.

(21) Appl. No.: 18/666,547

(22) Filed: May 16, 2024

Related U.S. Application Data

(60) Provisional application No. 63/506,225, filed on Jun. 5, 2023.

(51) Int. Cl.

| | |
|---|---|
| ***A63F 7/00*** | (2006.01) |
| ***A63F 3/00*** | (2006.01) |
| ***A63F 3/04*** | (2006.01) |

(52) U.S. Cl.

CPC ..... *A63F 3/0415* (2013.01); *A63F 3/00261* (2013.01); *A63F 3/00643* (2013.01); *A63F 3/00697* (2013.01); *A63F 2003/004* (2013.01); *A63F 2003/00798* (2013.01); *A63F 2003/0418* (2013.01); *A63F 2250/18* (2013.01)

(58) Field of Classification Search

None

See application file for complete search history.

(56) References Cited

U.S. PATENT DOCUMENTS

| | | | |
|---|---|---|---|
| 3,819,184 | A | 6/1974 | McPhail et al. |
| 9,561,537 | B2 | 2/2017 | Knutsson |

*Primary Examiner* — Sunit Pandya

(74) *Attorney, Agent, or Firm* — Reston Law Group, LLP; Ralph P. Albrecht

(57) ABSTRACT

A multiplayer or multi group of players board game where a plurality of players individually or in groups play against one another. The game may include, but is not limited to a surface tray 10 having a plurality of cavity areas 11 and the number of cavity areas 11 may be greater than the number non-cavity areas 12 and the non-cavity areas may include a raised section in between a plurality of cavity areas 11. The cavities on the surface tray 10 may be in a shape of uniform or non-uniform polygons or inverted half spherical cavities with the plurality of cavity areas arranged in a matrix form or a non-matrix form depending on the shape of the polygon. The surface tray 10 may be seated inside a frame 15 having at least four peripheral walls and a bottom side/base to hold the surface tray in place.

20 Claims, 7 Drawing Sheets

200

MATH SOLVING BOARD GAME APPARATUS, SYSTEM, METHOD AND/OR COMPUTER PROGRAM PRODUCT

CROSS REFERENCE TO RELATED APPLICATION

This is a US Nonprovisional Patent Application of U.S. Provisional Patent Application Ser. No. 63/506,225, filed Jun. 5, 2023, conf. no. 3518, entitled "MATH SOLVING BOARD GAME APPARATUS, SYSTEM, METHOD AND/OR COMPUTER PROGRAM PRODUCT," the contents of which is incorporated herein by reference in its entirety.

FIELD OF THE DISCLOSURE

The disclosure relates generally to board games and more particularly to educational board games.

BACKGROUND OF THE DISCLOSURE

Related Art

Conventional board games allow users or players to play a game of chance including throwing skills of a projectile such as a ball that may bounce off of a flat surface have been around for a long time. Conventional board games are for entertainment purposes and usually involve strategy and chance in order for a player to win, for example throwing a die, or spinning a spinner, in order to move forward on a board, conquering a space on the board to exclude other players from capturing that space or a combination of the two, but these board games seldom use mathematics and physical skills as a strategy to win a game.

Also, these conventional games that involve throwing a projectile such as a ball are usually a fixed game and do not include any type of creativity and the player can only play that game in the form that it comes. What is needed is a board game that overcomes the shortcomings of conventional board games.

SUMMARY OF THE INVENTION

Example embodiments of the current application may solve problems of conventional board games by creating a board game in which users or players can change rules of the game by customizing the board game and to entertain themselves at the skill level of the users or players.

Example embodiments of the current invention may include, but is not limited to, a board game having a surface tray, which may include a plurality of cavity areas and non-cavity areas. The surface tray, in an example embodiment, may include having a uniform or non-uniform polygon shape where the plurality of cavity areas and non-cavity areas are arranged in, e.g., but not limited to, a matrix form or a non-matrix form, etc., depending on the shape of the uniform or non-uniform polygon. The surface tray may be arranged in a tray with small, raised edges, in an example embodiment.

According to an example embodiment, one example of what makes the example embodiment of the board game fun, is the fact that the board game can offer different playing options for the players to play the game, in an example embodiment. This invention provides a board game that has multiple ways of combining the surface tray with game strategies, in an example embodiment. Wherein the board game comes with multiple surface trays that based on the players math skills the game can be player, in an example embodiment. These surface trays can also be interpreted as very easy, easy, medium, hard, and very hard game mode, wherein in the very easy mode the cavities have only numbers for addition and subtraction only and the players score by throwing a ball inside a cavity to score, in an example embodiment. The players then add/subtract the scores they receive, in an example embodiment. In the very easy mode the surface tray may have other mathematical terms such as fractions, multiplications, or division where the players have to apply to their total, in an example embodiment 1.

According to an example embodiment, other game modes may include, e.g., but may not be limited to, a medium and/or a hard form of the game. Example embodiments of the other game modes may include having other or alternative forms of mathematical equations and terms which can involve in one example embodiment, a mathematical operation term, such as, e.g., but not limited to, any mathematical operation term such as, e.g., but not limited to, a square, a square root, a percentage, an exponential, a logarithm, addition, multiplication, subtraction, division, multiplication by pi, algebraic equations, or any other level of mathematical operation that may be suitable, or desired, according to an example embodiment. In an example embodiment of a very hard mode the surface tray may include, e.g., but not limited to, other advanced mathematical operations such as, e.g., but not limited to, trigonometric equations, ratios, calculus, advanced middle school, high school, and/or any college level mathematics, etc., in an example embodiment.

According to an example embodiment, in order for the game to be fun for all age groups the board game, in one example embodiment, can also have a blank surface tray wherein the players can write, using, e.g., but not limited to, dry erase pen, erasable ink and/or erasable graphite pencil lead, etc., their own mathematical operation terms or numbers based on the skill level of the users or players or based on the level of knowledge of the users or players, which has been learned in school or college by the users or players, according to an example embodiment. Therefore, there are many example alternative forms of surface tray, which may be used or provided, for all ages and mathematical skill levels and the game is designed to make the process of learning mathematics fun for the users or players, according to an example embodiment.

According to one example embodiment, other than the example system tray there may include, e.g., but not limited to, at least three example playing options to play the example board game. According to an example embodiment, the users or players can play, an example first option, where there may be a certain number of turns and the players may have to throw a ball into the example cavities and may earn as much of a score per player as the player can, in order to win the game, in an example embodiment. According to an example embodiment, the example second option may include winning the game by reaching or exceeding a certain predetermined score goal, which the players or users can agree upon prior to playing and throw the balls into the cavities and may earn as many scores as they can to reach or exceed that certain predetermined score, according to an example embodiment. According to an example embodiment, the example third option may include earning as many scores as the players or users can without going over a certain predetermined value, in this example third option the players may have to also consider the probability factor of what the chances are to go over the certain predetermined score and may add another example layer of decision making, in an example embodiment. Therefore, according to an example embodiment, the example combination of the example surface trays and options to play may make this multiplayer or multi group player game a fun board game while the players or users may combine, e.g., but not limited to, learning math, strategy, and throwing skills, etc., in order to win a game, in an example embodiment.

According to various example embodiments of the current application, an apparatus, system, method and/or computer program product may include a multi-player or multigroup-player board game system, method and/or computer program product, which may in example embodiments include: a frame with a base configured to enable players to choose a surface tray from a plurality of surface trays to place inside the frame with the base and to replace an existing surface tray with another surface tray inside the frame with the base, wherein the existing surface tray or the another surface tray may include: a plurality of cavity areas and non-cavity areas, wherein a number of cavity areas of said plurality of the cavity areas is greater than a number of the non-cavity areas and the non-cavity areas comprise at least one raised section in between or adjacent the plurality of cavity areas, the plurality of the cavity areas are disposed on the existing or the another surface tray, arranged in a matrix form, and have uniform shapes, wherein each of the plurality of surface trays having the plurality of cavities and inside of some of these cavities a number value and a mathematical equation or mathematical operation is indicated, wherein the board game is configured to receive a light bouncy ball having a size similar to the size of the cavity area, when projected onto one of the plurality of the surface trays in order to land in a cavity of the one of the plurality of surface trays, and wherein the cavity is configured to hold the light bouncy ball; and wherein some of the cavity areas where the ball is expected to more frequently fall inside are blank.

According to one example embodiment, the multiplayer or multigroup-player board game may include where at least one fully blank surface tray is provided wherein the at least one fully blank surface tray is configured to allow the players to write number values, mathematical equations, mathematical operations, or any other game rules on the bottom of the cavities to customize the game of the players.

According to one example embodiment, the multiplayer or multigroup-player board game may include where the players choose from at least three different playing options.

According to one example embodiment, the multiplayer or multigroup-player board game may include where a first playing option is each player or group of players has a certain number of throws and the players start in a turn by turn basis, a player throws the ball by bouncing off the ball off a primary surface outside of the surface tray and the ball lands in a cavity, the player then adds/subtracts/divides/multiplies or does any other mathematical equation or mathematical operation mentioned in the cavity including doing nothing when the cavity is blank and adds an earned score to a sum of previously earned scores; then the player counts a remaining number of throws and while the number of throws is less than the certain number of throws the players keep on playing and the game goes back to throwing the balls onto the surface tray; and once the player's number of throws is finished, the earned scores of each player are added up and compared with other player's earned score and the player with the highest earned score wins.

According to one example embodiment, the multiplayer or multigroup-player board game may include where a second playing option is when the players or group of players reach or exceed a predetermined score, in this game play the players or groups of players start in a turn by turn basis, players throw the ball by bouncing the ball off a primary surface outside of the surface tray or directly into the surface tray and the ball lands in a cavity; the player then adds/subtracts/divides/multiplies or does any other mathematical equation mentioned in the cavity and adds earned score to a sum of previously earned score; then the player counts the earned score and while the earned score is less than a predetermined score the players keep on playing and the game goes back to throwing the balls onto the surface tray; and once one of the players or group of players reaches or exceeds the predetermined score, the game ends and the player who met or exceeded the predetermined score first wins the game.

According to one example embodiment, the multiplayer or multigroup-player board game may include where a third playing option is to agree on a score and the players or group of players have to be as close as possible to that score without going over that score; In this game play the players or group of players start in a turn by turn basis, a player throws the ball by bounding off a ball off a primary surface outside of the surface tray or throw the ball directly into the cavities and the ball lands in a cavity, the player(s) then adds/subtracts/divides/multiplies or does any other mathematical equation mentioned in the cavity and adds earned score to a sum of previously earned scores; then the player counts the earned score and while the earned score is less than the agreed upon score the player has to decide if the player or group of players want to keep on playing or want to stop; When the player decides to play one more round, the game goes back and the player throws the ball and adds the earned score where the ball landed in the cavity; when a total earned score is more than the agreed upon score the player who exceeded the agreed upon score loses the game and is eliminated; when the total earned score is still less than the agreed upon score the player has to decide to throw one more ball or stop; When the player decides to throw one more ball the game is repeated; when the player decides to stop, the player waits for other players or group of players to stop and the earned scores for players who did not go over the agreed upon score are compared and the player with closest score to the agreed upon score is considered the winner.

According to one example embodiment, the multiplayer or multigroup-player board game may include where the players may also choose light bouncy balls with cavities or grooves or any other irregular cavities on them in order to make landing of the balls inside the surface tray more unpredictable and earn more score.

According to one example embodiment, the multiplayer or multigroup-player board game may include where, the light bouncy balls with cavities or grooves may have multi-score points and landing one of these balls inside a cavity of the surface tray can multiply the number value inside the cavity of the surface tray by the ball's multi-score points; the player can lose a turn because the light bouncy balls with cavities or grooves might not land inside the surface tray and the player loses a turn.

According to one example embodiment, the multiplayer or multi-group player board game may include where the surface trays can be selected from predetermined surface trays having preassigned number values and mathematical equations written on the bottom of the cavities, a blank surface tray may be selected where the players can write their own number values, mathematical equations, and text so when the ball falls inside the cavity with text, the players have to follow or perform the text.

According to one example embodiment, the multiplayer or multi-group player board game may include where each of the plurality of surface trays have preassigned number values, mathematical equations and blank spaces that are designed for different skill players.

According to one example embodiment, the multiplayer or multi-group player board game may include where when a ball lands inside a cavity with mathematical equation or mathematical operation or mathematical function, the mathematical equation or the mathematical operation or the mathematical function is applied to the sum of previously earned scores.

According to one example embodiment, the multiplayer or multi-group player board game may further include where at least one or more of: a) wherein a first playing option is each player or group of players has a certain number of throws and the players start in a turn by turn basis, a player throws the ball by bouncing off the ball off a primary surface outside of the surface tray and the ball lands in a cavity, the player then adds/subtracts/divides/multiplies or does any other mathematical equation or mathematical operation mentioned in the cavity including doing nothing when the cavity is blank and adds an earned score to a sum of previously earned scores; then the player counts a remaining number of throws and while the number of throws is less than the certain number of throws the players keep on playing and the game goes back to throwing the balls onto the surface tray; and once the player's number of throws is finished, the earned scores of each player are added up and compared with other player's earned score and the player with the highest earned score wins; b) wherein a second playing option is when the players or group of players reach or exceed a predetermined score, in this game play the players or groups of players start in a turn by turn basis, players throw the ball by bouncing the ball off a primary surface outside of the surface tray or directly into the surface tray and the ball lands in a cavity; the player then adds/subtracts/divides/multiplies or does any other mathematical equation mentioned in the cavity and adds earned score to a sum of previously earned score; then the player counts the earned score and while the earned score is less than a predetermined score the players keep on playing and the game goes back to throwing the balls onto the surface tray; and once one of the players or group of players reaches or exceeds the predetermined score, the game ends and the player who met or exceeded the predetermined score first wins the game; or c) wherein a third playing option is to agree on a score and the players or group of players have to be as close as possible to that score without going over that score; In this game play the players or group of players start in a turn by turn basis, a player throws the ball by bounding off a ball off a primary surface outside of the surface tray or throw the ball directly into the cavities and the ball lands in a cavity, the player(s) then adds/subtracts/divides/multiplies or does any other mathematical equation mentioned in the cavity and adds earned score to a sum of previously earned scores; then the player counts the earned score and while the earned score is less than the agreed upon score the player has to decide if the player or group of players want to keep on playing or want to stop; When the player decides to play one more round, the game goes back and the player throws the ball and adds the earned score where the ball landed in the cavity; when a total earned score is more than the agreed upon score the player who exceeded the agreed upon score loses the game and is eliminated; when the total earned score is still less than the agreed upon score the player has to decide to throw one more ball or stop; When the player decides to throw one more ball the game is repeated; when the player decides to stop, the player waits for other players or group of players to stop and the earned scores for players who did not go over the agreed upon score are compared and the player with closest score to the agreed upon score is considered the winner.

According to one example embodiment, the multiplayer or multi-group player board game may include where the board game is simulated in a computer based game, wherein the board game comprises a set of instructions embodied on a computer accessible storage medium which when executed on an electronic computer processor, performs the simulated steps described.

According to one example embodiment, the multiplayer or multi-group player board game may include where the board game is configured to allow users or players to play other users remotely or to play automated users.

According to one example embodiment, a computer implemented multi-player or multigroup-player board video game method may include electronically simulating, on at least one electronic computer processor, a frame electronic representation with a base electronic representation configured to enable players to electronically choose a surface tray electronic representation from a plurality of surface tray electronic representations to electronically display being placed inside the frame electronic representation with the base electronic representation and to electronically replace an existing surface tray electronic representation with another surface tray electronic representation inside the frame electronic representation with the base electronic representation, where the existing surface tray electronic representation or the another surface tray electronic representation may include: a plurality of cavity area electronic representations and non-cavity area electronic representations, wherein a number of cavity area electronic representations of said plurality of the cavity area electronic representations is greater than a number of the non-cavity area electronic representations and the non-cavity area electronic representations comprise at least one raised section electronic representation in between or adjacent the plurality of cavity area electronic representations, the plurality of the cavity area electronic representations are disposed on the existing or the another surface tray electronic representation, arranged in a matrix electronic representation form, and have uniform electronic representation shapes, where each of the plurality of surface tray electronic representation s having the plurality of cavity area electronic representations and inside of some of these cavity area electronic representations a number value and a mathematical equation or mathematical operation is indicated, where the board video game is configured to receive a light bouncy ball electronic representation having an electronic representation size similar to the electronic representation size of the cavity area electronic representation, when projected onto one of the plurality of the surface tray electronic representations in order to electronically represent landing in a cavity area electronic representation of the one of the plurality of surface tray electronic representations, and where the cavity area electronic representation is configured to electronically represent holding the light bouncy ball electronic representation; and where some of the cavity area electronic representations where the light bouncy ball electronic representation is expected to more frequently fall inside are blank electronic representations.

According to one example embodiment, a nontransitory computer program product embodied on a computer accessible storage medium may include a plurality of computer readable instructions, which when executed on an electronic computer processor is configured to perform a multi-player or multigroup-player board video game method may include: electronically simulating, on at least one electronic computer processor, a frame electronic representation with a base electronic representation configured to enable players to electronically choose a surface tray electronic representation from a plurality of surface tray electronic representations to electronically display being placed inside the frame electronic representation with the base electronic representation and to electronically replace an existing surface tray electronic representation with another surface tray electronic representation inside the frame electronic representation with the base electronic representation, wherein the existing surface tray electronic representation or the another surface tray electronic representation may include: a plurality of cavity area electronic representations and non-cavity area electronic representations, wherein a number of cavity area electronic representations of said plurality of the cavity area electronic representations is greater than a number of the non-cavity area electronic representations and the non-cavity area electronic representations comprise at least one raised section electronic representation in between or adjacent the plurality of cavity area electronic representations, the plurality of the cavity area electronic representations are disposed on the existing or the another surface tray electronic representation, arranged in a matrix electronic representation form, and have uniform electronic representation shapes, where each of the plurality of surface tray electronic representation s having the plurality of cavity area electronic representations and inside of some of these cavity area electronic representations a number value and a mathematical equation or mathematical operation is indicated, where the board video game is configured to receive a light bouncy ball electronic representation having an electronic representation size similar to the electronic representation size of the cavity area electronic representation, when projected onto one of the plurality of the surface tray electronic representations in order to electronically represent landing in a cavity area electronic representation of the one of the plurality of surface tray electronic representations, and where the cavity area electronic representation is configured to electronically represent holding the light bouncy ball electronic representation; and where some of the cavity area electronic representations where the light bouncy ball electronic representation is expected to more frequently fall inside are blank electronic representations.

According to one example embodiment, a computer system of providing a multi-player or multigroup-player board video game, the system may include: at least one electronic computer processor of a board video game hosting service provider; and at least one electronic memory coupled to said at least one electronic computer processor, where said at least one electronic computer processor may be configured to: electronically simulate a frame electronic representation with a base electronic representation configured to enable players to electronically choose a surface tray electronic representation from a plurality of surface tray electronic representations to electronically display being placed inside the frame electronic representation with the base electronic representation and to electronically replace an existing surface tray electronic representation with another surface tray electronic representation inside the frame electronic representation with the base electronic representation, where the existing surface tray electronic representation or the another surface tray electronic representation may include: a plurality of cavity area electronic representations and non-cavity area electronic representations, where a number of cavity area electronic representations of said plurality of the cavity area electronic representations is greater than a number of the non-cavity area electronic representations and the non-cavity area electronic representations comprise at least one raised section electronic representation in between or adjacent the plurality of cavity area electronic representations, the plurality of the cavity area electronic representations are disposed on the existing or the another surface tray electronic representation, arranged in a matrix electronic representation form, and have uniform electronic representation shapes, where each of the plurality of surface tray electronic representations having the plurality of cavity area electronic representations and inside of some of these cavity area electronic representations a number value and a mathematical equation or mathematical operation is indicated, where the board video game is configured to receive a light bouncy ball electronic representation having an electronic representation size similar to the electronic representation size of the cavity area electronic representation, when projected onto one of the plurality of the surface tray electronic representations in order to electronically represent landing in a cavity area electronic representation of the one of the plurality of surface tray electronic representations, and where the cavity area electronic representation is configured to electronically represent holding the light bouncy ball electronic representation; and where some of the cavity area electronic representations where the light bouncy ball electronic representation is expected to more frequently fall inside are blank electronic representations.

According to one example embodiment, the system may further include: a data communications network, electronically coupled to said at least one electronic computer processor of said board video game hosting service provider; a plurality of electronic user devices coupled to said data communications network via at least one or more of a web-browser based web application or a mobile device app; and an application server coupled to said data communications network, configured to enable remote multiplayer play of the multi-player or multigroup-player board video game.

DETAILED DESCRIPTION OF THE INVENTION

Figure 1:
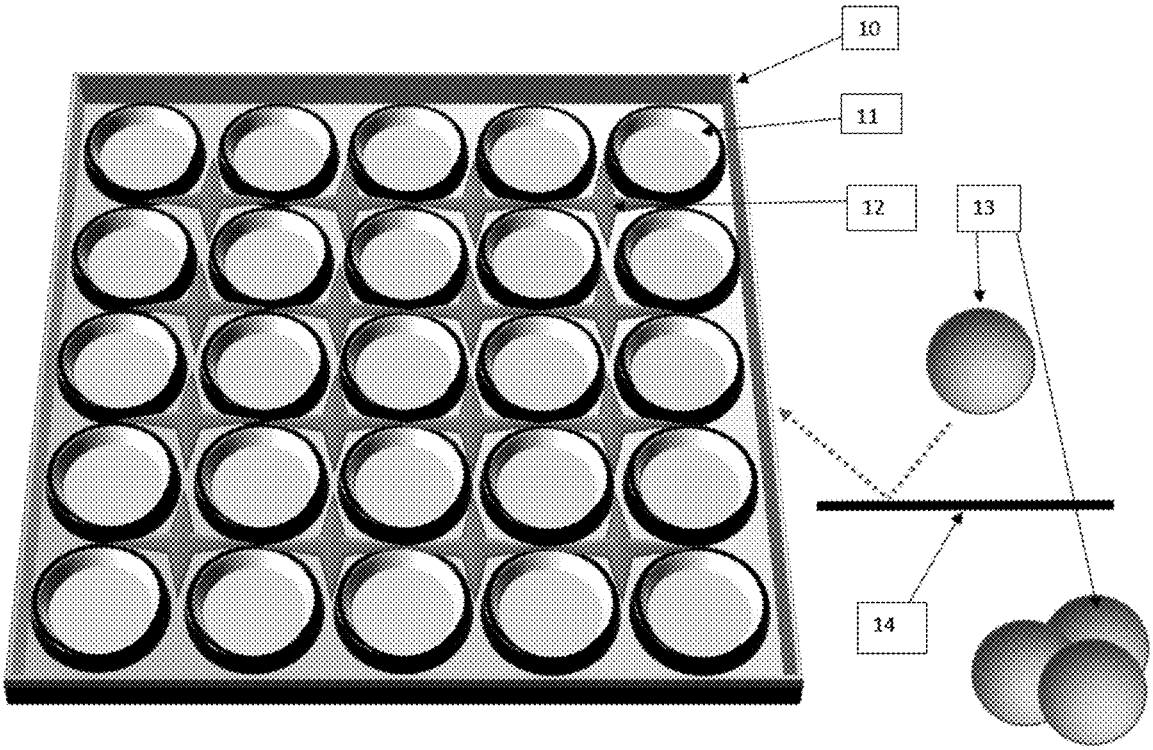
FIG. 1 depicts an illustration of an example isometric view of an example board game structure where an example ball is illustrated, being thrown by players or users (not shown) into an example surface tray, according to an example embodiment.

FIG. 1 depicts an illustration of an example isometric view 100 of an example board game 100 structure where an example ball 13 is illustrated, being thrown (or tossed) by players or users (not shown) into an example surface tray 10 as illustrated with example, but not-limiting cavities 11 (which may be voids, concave portions in the surface tray 10, and/or circular and/or semispherical, cup and/or indented portions) and example raised portions 12 (which may be convex and or raised relative to the surface and the cavity portions 11) between example cavities 11. As illustrated in diagram 100, in the example illustration, a ball 13 is shown being bounced off an example external flat surface (a plane shown in edge view as an example line, which could be a tile floor, a table surface, etc.), and into the example surface tray 10 and into one of the example cavities 11 adjacent and/or between noncavity raised portions 12 and/or a periphery of the surface tray 10, according to an example embodiment. Although the surface tray 10 is shown as an example quadrilateral, rectangular, parallelogram shape, in the example illustration a square shape, this is not to be limiting, but alternative designs which may resemble in outer periphery other shapes, which may not be limited to a square, but rather in other example embodiments may include other shapes such as, e.g., but not limited to, other polygonal shapes and/or other shapes, such as, e.g., but not limited to, a rectangle, quadrilateral, and/or other polygon like a pentagon, hexagon, octagon, nonagon, circle, etc., and, according to an example embodiment. Sides of the board need not be regular of similar dimension, but may be oblong, rectangular, oval, elliptical, and/or other design with right angled or other angled corners, and/or rounded corners, and may be contained within an outer package and/or box and/or container. The inner arrangement may be regular as illustrated, oriented in rows and/or columns, and/or other arrangement such as a honeycomb and/or alternative array design, and/or irregularly shaped in some alternative embodiments.

Figure 2:
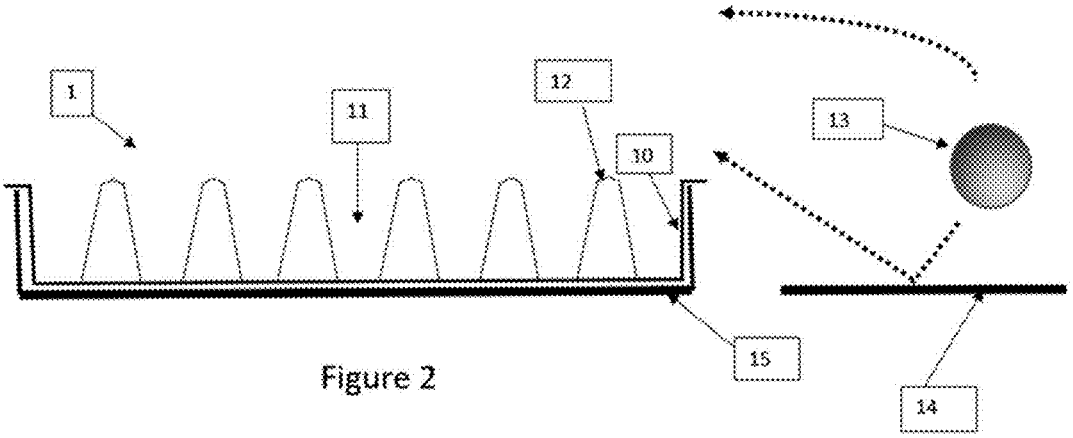
FIG. 2 depicts an example side cross-sectional orthographic view of an example board game where a ball is thrown into a surface tray that may be sitting inside an example frame about a periphery of the example surface tray. The example ball (or other example projectile) can be, e.g., thrown or tossed, by the example player or user, directly into or onto a top surface of the example surface tray or can be bounced off of a primary surface (external to the board-game) into or onto the example surface tray, according to an example embodiment.

FIG. 2 depicts an example side cross-sectional orthographic view 200 of an example board game 10 where an example ball 13 (shown chosen from a group of multiple balls shown, but not labeled) is illustrated being thrown (by a user or player not depicted) into or onto an example surface tray 10 that may be sitting, according to one example embodiment, inside an example frame 15 about a periphery of the example surface tray 10. The example ball (or other example projectile) can be, e.g., thrown or tossed, by the example player or user, directly into or onto a top surface of the example surface tray or can be bounced off of a primary surface 14 (external to the boardgame) into or onto the example surface tray 10, according to an example embodiment. According to one example embodiment, surface tray 11, may be constructed of, e.g., but not limited to, plastic, metal, cardboard, composite, and/or paper material, etc., and may be placed within an outer periphery which may include one or more walls, such as the example four vertical walls illustrated (not labeled, see FIG. 2, element 15), according one example embodiment.

According to an example embodiment, as depicted in the illustrations of FIGS. 1 and 2, an example multiplayer or multi group players board game 100, 200 is disclosed where a group of players or users (not shown or labeled) may individually or in groups play against one another, according to example embodiments. The game may include a board 100, which may include, e.g., but is not limited to, as illustrated an example surface tray 10 which may include, e.g., having a plurality of cavity areas 11, and the number of cavity areas 11 may, in one example embodiment, be greater than the non-cavity areas 12 (which may be convex to the surface of the example surface tray 10) and the non-cavity areas 12 may be raised sections in between a plurality of the example cavity areas 11, in one example embodiment. As illustrated in one example embodiment, surface tray 10 may include one or more convex portions and/or concave portions, relative to the median elevation of the surface tray 10, and may include in some example embodiments, a raised portion about a periphery of the surface tray 10, in one example embodiment, but need not be, in all example embodiments. The ball may be bounced initially of the external flat surface 14, as illustrated, and/or may be tossed at angle across the surface tray 10, directly, according to various example embodiments, depending on various example rules. When upon bouncing onto a surface area portion of the surface tray 10, according to an example embodiment, a ball 13 may hit a raised section and/or portion (not individually labeled) of the non-cavity areas 12, the ball 13 may bounce off in any of various random different directions and the ball may be guided via its trajectory of toss, towards one or more of the nearby example cavities 11, which may be adjacent or near the point of bouncing. The non-cavity areas 12 may also have an example vertical section, as shown in the example embodiments, with an example steep slope and may near the top of the raised section may include an example rounded and/or curved, and/or angled top and/or raised and/or peak portion and/or pointed and/or rounded and/or curved upper portion, according to example embodiments.

According to an example embodiment, the cavities on a surface tray 10 may be in a shape of either uniform or non-uniform polygons, circles, squares, and/or other shapes, or inverted half spherical, and/or cup portions, with the plurality of cavity areas 11 arranged in either a matrix form and/or a non-matrix form, as an array, as regular or irregular rows and columns, depending on the shape of the polygon. The surface tray 10 may include seating inside a frame 15, as shown, in the example, having four peripheral walls and a bottom side/base to hold the surface tray in place, according to one example embodiment. Not shown an accompanying lid may be included to marry and/or couple with the lower frame 15 to create an enclosed container, in some example embodiments.

According to an example embodiment, the board game 1 may include, but is not limited to, a plurality of light bouncy balls 13, which may have different colors or a different group of colors, which could be, according to example embodiments, any type of ping-pong ball, rubber ball, clastic ball, composite, plastic and/or other material, and/or any other type of ball composed of any well known material, that could bounce off an example primary surface 14 (which could be a table top, floor, and/or other planar support surface upon which the board game 1 is placed for play) and/or thrown directly into the surface tray 10 in an example embodiment. Players bounce the balls off a primary surface 14, which could be an adjacent surface or a surface in which the board game is placed on, into the surface tray 10, in example embodiments. Each cavity 11 may include a similar shape and/or size as one of the balls 13 and when a ball 13 lands in the surface tray 10 the balls 13 may land in one of the cavities 11 (that is, only one mutually exclusive cavity 11, in an example embodiment) and the cavities 11 may hold the balls 13 in place.

Figure 3:
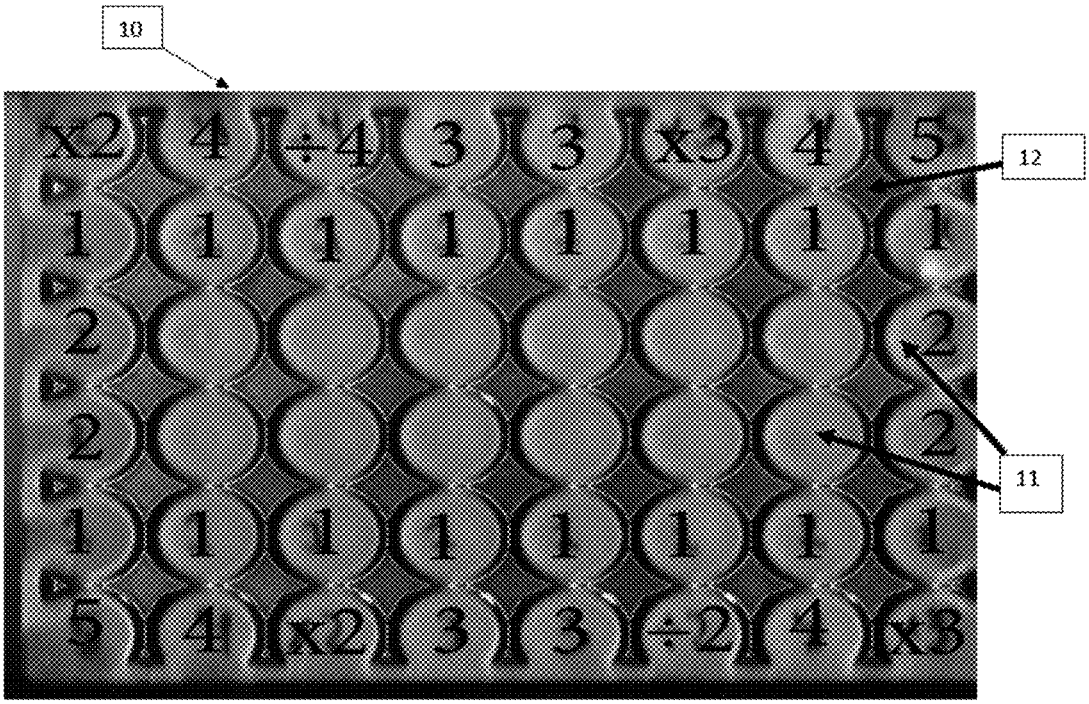
FIG. 3 depicts an illustration of an example top view of an embodiment of the example board game, which may include where an example surface tray may be shown including where the example bottom of the example cavities may include the example, but nonlimiting, illustrated number values, example mathematical equation operations or operands, or where as shown in an example embodiment, some cavities may be left blank, according to an example embodiment.

FIG. 3 depicts an example illustration 300 of an example top view of an embodiment of the example board game, which may include where an example surface tray may be shown including where the example bottom of the example cavities may include the example, but nonlimiting, illustrated number values, example mathematical equation operations or operands, or where as shown in an example embodiment, some cavities may be left blank, according to an example embodiment.

According to an example embodiment, FIG. 3, The surface tray 10 having a plurality of cavities 11 and on the bottom of each cavity 11 a number value or mathematical equation is indicated, wherein the number value may indicate a score a player receives when a ball 13 lands in the cavity 11. Some surface tray cavities 11 might have, e.g., but not limited to, a multiply by a double, a triple, and/or any other bonus score and when the player's ball 13 lands in one of the cavities 11 the player's score may double and/or triple, etc., accordingly. Some cavities may have, e.g., but not limited to, a divide by two, three, or four, etc., and the Player's score may divide by two, three, or four, etc., accordingly. Some of the cavities 11 may have no point values and generally those are the cavies 11 in which a ball more frequently or easily may fall in them. These no point cavities 11 may be the middle cavities 11 where the probability of a ball falling in them may be higher than the other cavities (based on increased quantity) and when the ball falls in these blank (no point) cavities 11 the player's score does not change, however, the player's number of turns may decrease as this may be considered as a throw and may give the other player a chance to score more points, according to an example embodiment. In various example embodiments, rules may be made mandatory, and/or may be relaxed, according to various alternative embodiments of the claimed invention.

According to an example embodiment, the surface tray 10 may be a removable surface tray 10 wherein the board game 1 may include, e.g., but may not be limited to, a plurality of (more than one) surface trays 10 and depending on the player's preference the surface tray 10 may be replaced from basic math to any other levels of math, more advanced, and/or less difficult, according to alternative example embodiments. This is possible by lifting an already placed surface tray 10 from the frame 15 and placing another alternative, desired surface tray 10 into the outer periphery frame 15, according to an example embodiment. In basic math, according to an example embodiment, the cavities 11 may have numbers and/or also may multiply by a number and/or may divide by a number, wherein each player may keep track of their earned score by, e.g., but not limited to, adding, multiplying, dividing, or subtracting scores from their total earned score based on where the ball lands on the surface tray 10, in the example embodiment. In an example more advanced surface tray 10 the players might need to solve equations, use fractions, square roots, and/or write their own custom numbers/math equations, according to example embodiments, and/or other mathematical operations and/or equations, and/or mathematical functions. The example removable trays 10 may allow players of all ages to participate and for players to challenge their math skills and with the example custom surface tray 10 the players can practice their math skills according to their math levels and have fun while learning math, in one example embodiment. In another example embodiment, other skills may be developed by alternative trays which may include other example skills based training trays, including, e.g., other educational skills, consumer financial skills, reading skills, spelling skills, etc. without parting from the spirit of the claimed invention. The example trays can be selected from predetermined example trays having example number values and mathematical equations written on the example bottom of the cavities 11 or the players can write (using example ink and/or other indicia, dry erase ink, erasable ink or pencil lead, etc.) their own number values, mathematical equations, and/or even text, etc., so when the ball falls within the text area the players have to follow or perform the instructions included in the example text, according to an example embodiment. The text could be "lose a turn", "deduct a specific value", "make a player lose a turn", "choose a player to deduct a specific score from their total score", "50% off", or any other command to make the game more exciting, according to an example embodiment. Some of the cavities 11 where the ball 13 more frequently or easily may fall inside can be left blank in order to make the game more difficult, according to an example embodiment.

According to an example embodiment, in order to make the game more interesting and more difficult the players may choose light bouncy balls 13 with cavities 11 and/or grooves and/or dimples and/or surface coating, etc., on them in order to make the landing of the balls inside the surface tray more unpredictable, for example using a golf ball shape bouncy ball or any other irregular cavities and/or grooves on the balls, according to an example embodiment. These light bouncy balls 13 with cavities 11 and/or grooves may have multi-score points and landing one of these balls inside a cavity can multiply the number value inside the cavity 11 by the ball's multi-score point; the player can lose a turn because the light bouncy balls 13 with cavities 11 and/or grooves might not land inside the surface tray and the player may lose a turn, or have another penalty, according to an example embodiment.

According to an example embodiment, the board game 1 can be played by a plurality of players either individually or in groups wherein the game can be played in, an example, at least three (or more, or less) playing option(s) and/or customized by the players wherein the players choose a playing option from a plurality of options, according to an example embodiment.

Figure 4:
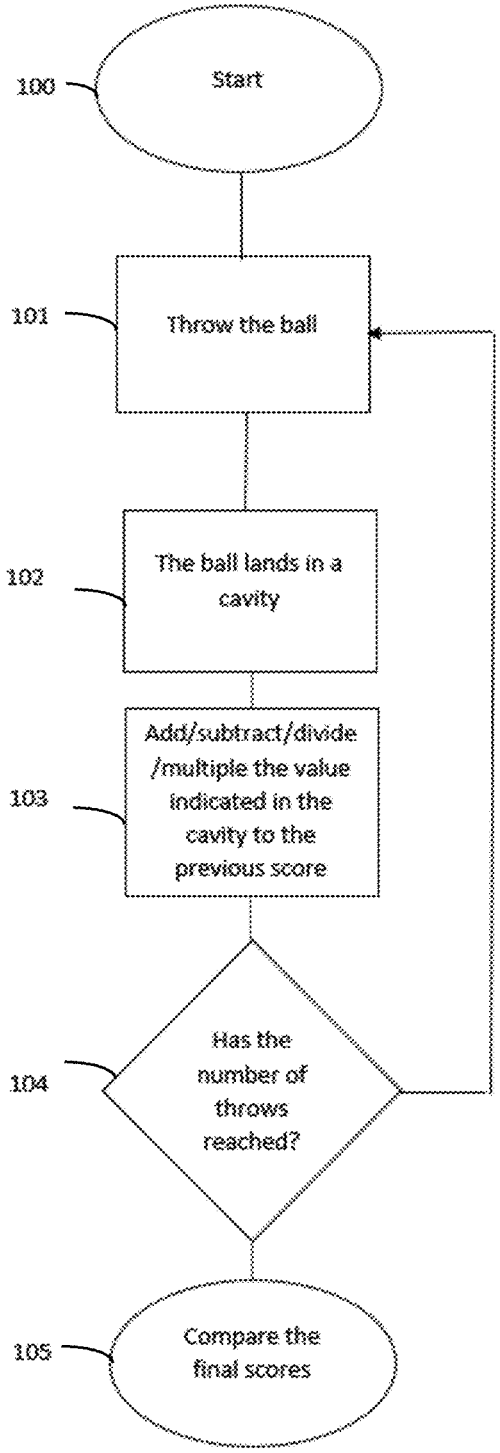
FIG. 4 depicts an illustration of an example of an embodiment of a user or player play process flow diagram of an example first playing option to play the example board game, according to an example embodiment.

FIG. 4 depicts an illustration 400 of an example of an embodiment of a user or player play process flow diagram 400 of an example first playing option to play the example board game, according to an example embodiment.

According to an example embodiment, FIG. 4, first playing option 400 to play the example game 1 may include that each player or group may have a certain number of throws and/or the players may start (100 of FIG. 4) in a turn by turn basis, player may throw the ball 13 (step 101 of FIG. 4) by bouncing off the ball off a primary surface 14 outside of the surface tray 10 and the ball 13 lands in a cavity 11 (step 102 of FIG. 4), the player then adds/subtracts/divides/multiplies or does any other mathematical equation mentioned in the cavity including doing nothing when the cavity 11 is blank and adds earned score to a sum of previously earned scores (step 103 of FIG. 4), according to an example embodiment. In step (104 of FIG. 4) the player counts the remaining number of throws and while the number of throws is less than the certain number of throws the players keep on playing and the game goes back into step (101 of FIG. 4) and throwing the balls 13 onto the surface tray 10, according to an example embodiment. Once the players number of throws is finished in step (104 of FIG. 4) the earned scores are added up and compared in step (105 of FIG. 4) and the player with the highest score wins, according to an example embodiment.

Figure 5:
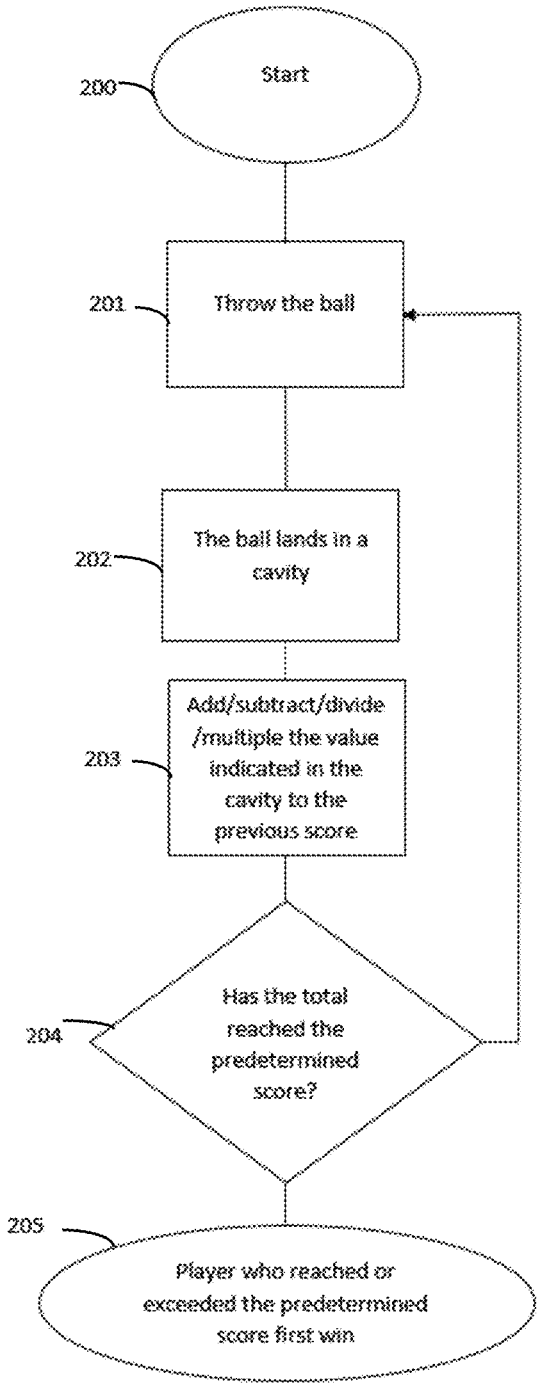
FIG. 5 depicts an illustration of an example of an embodiment of a user or player play process flow diagram of an example second playing option to play the board game, according to an example embodiment.

FIG. 5 depicts an illustration 500 of an example of an embodiment of a user or player play process flow diagram of an example second playing option to play the board game, according to an example embodiment, according to an example embodiment.

According to an example embodiment, FIG. 5, second playing option to play is when the players or group of players reach or exceed a predetermined score, according to an example embodiment. In this game play the players or groups start (step 200 of FIG. 5) in a turn by turn basis, players throw the ball (step 201 of FIG. 5) by bouncing the ball off a primary surface 14 outside of the surface tray 10 or directly into the surface tray 10 and the ball 13 lands in a cavity (step 202 of FIG. 5), the player then adds/subtracts/divides/multiplies or does any other mathematical equation mentioned in the cavity 11 and adds earned score to a sum of previously earned scores (step 203 of FIG. 5), according to an example embodiment. In step (204 of FIG. 5) the player counts the earned score and while the earned score is less than a predetermined score the players keep on playing and the game goes back into step (201 of FIG. 5) and throwing the balls onto the surface tray 10, according to an example embodiment. Once one of the players or group of players reaches or exceeds the predetermined score in step (204 of FIG. 5) the game ends in step (205 of FIG. 5) and the player who met or exceeded the predetermined score first wins the game, according to an example embodiment.

Figure 6:
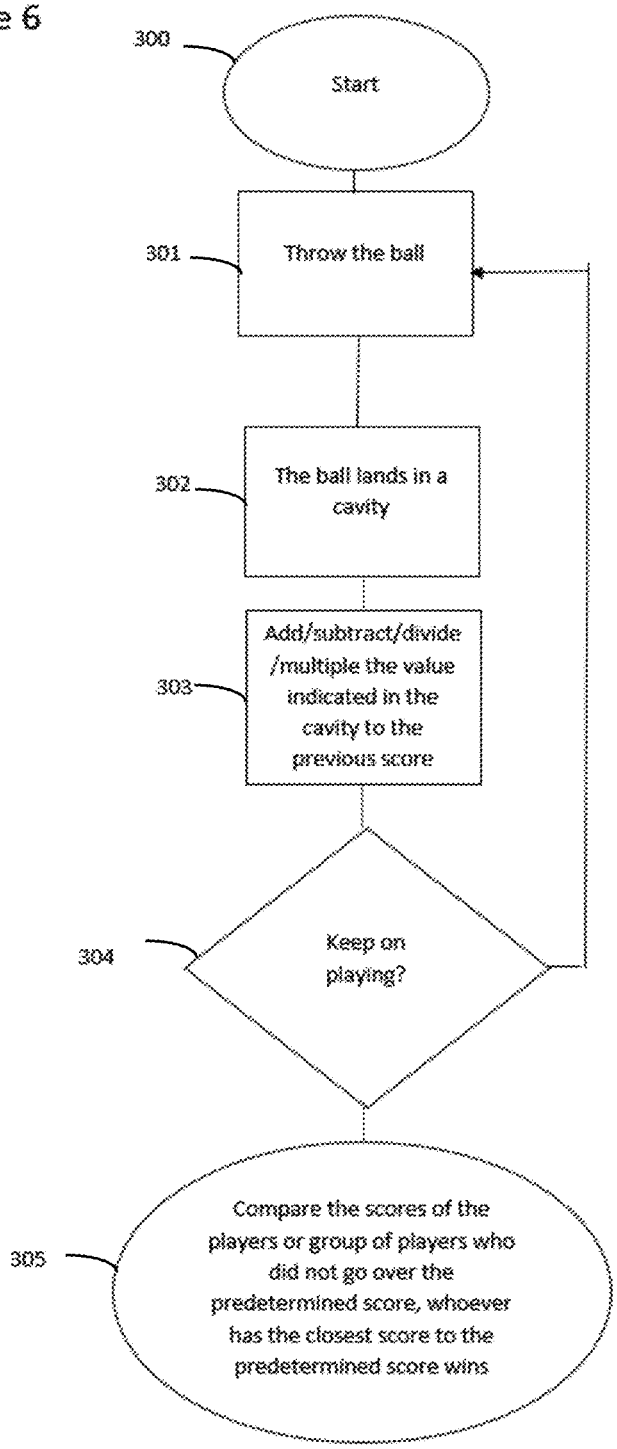
FIG. 6 depicts an illustration of an example of an embodiment of a user or player play process flow diagram of an example third playing option to play the board game, according to an example embodiment.

FIG. 6 depicts an illustration 600 of an example of an embodiment of a user or player play process flow diagram of an example third playing option to play the board game, according to an example embodiment.

According to an example embodiment, FIG. 6, third playing option is to agree upon a score and the players or group of players have to be as close as possible to that score without going over that score, according to an example embodiment. In this game play the players or group of players start (step 300 of FIG. 6) in a turn by turn basis, player throws the ball (step 301 of FIG. 6) by bounding off a ball 13 off a primary surface 14 outside of the surface tray 10 or throw the ball directly into the cavities 11 and the ball 13 lands in a cavity (step 302 of FIG. 6), the player(s) then adds/subtracts/divides/multiplies or does any other mathematical equation mentioned in the cavity and adds earned score to a sum of previously earned scores (step 303 of FIG. 6), according to an example embodiment. In step (304 of FIG. 6) the player counts the earned score and while the earned score is less than the agreed upon score the player has to decide if the player or group of players want to keep on playing or want to stop, according to an example embodiment. When the player decides to play one more round in step (304 of FIG. 6) the game goes to steps 301-304 and the player throws the ball and adds the earned score where the ball 13 landed in the cavity 11, according to an example embodiment. If a total earned score is more than the agreed upon score the player who exceeded the agreed upon score loses the game and is eliminated, according to an example embodiment. If the total earned score is still less than the agreed upon score the player has to decide to throw one more ball or stop, according to an example embodiment. When the player decides to throw one more ball the process of steps 301-304 of FIG. 6 repeats, according to an example embodiment. When the player decides to stop in step (305 of FIG. 6), the player waits for other players or group of players to stop and the earned scores for players who did not go over the agreed upon score are compared and the player with closest score to the agreed upon score is considered the winner (305), according to an example embodiment. In this game play each player may hide the sum of previously earned scores from other players or group of players in order to trick other players or group of players to go over the agreed upon score by throwing an unnecessary ball or not go over their sum of previously earned score and lose the game when the sum of previously earned scores are compared, according to an example embodiment.

According to an example embodiment, yet another playing option is to use a combination of first to third playing option or play a game based on a customized rule, according to an example embodiment. There is at least one fully blank surface tray (10) where the players can write their own number values, mathematical equations, or any other command/game rules on the bottom of the cavities to customize their game, according to an example embodiment. To find out which player starts first the players throw balls in a surface tray (10) one by one and the player with highest number value starts first. when a ball lands inside a cavity with mathematical equation, the math equation is applied to the sum of previously earned scores, according to an example embodiment.

Figure 7:
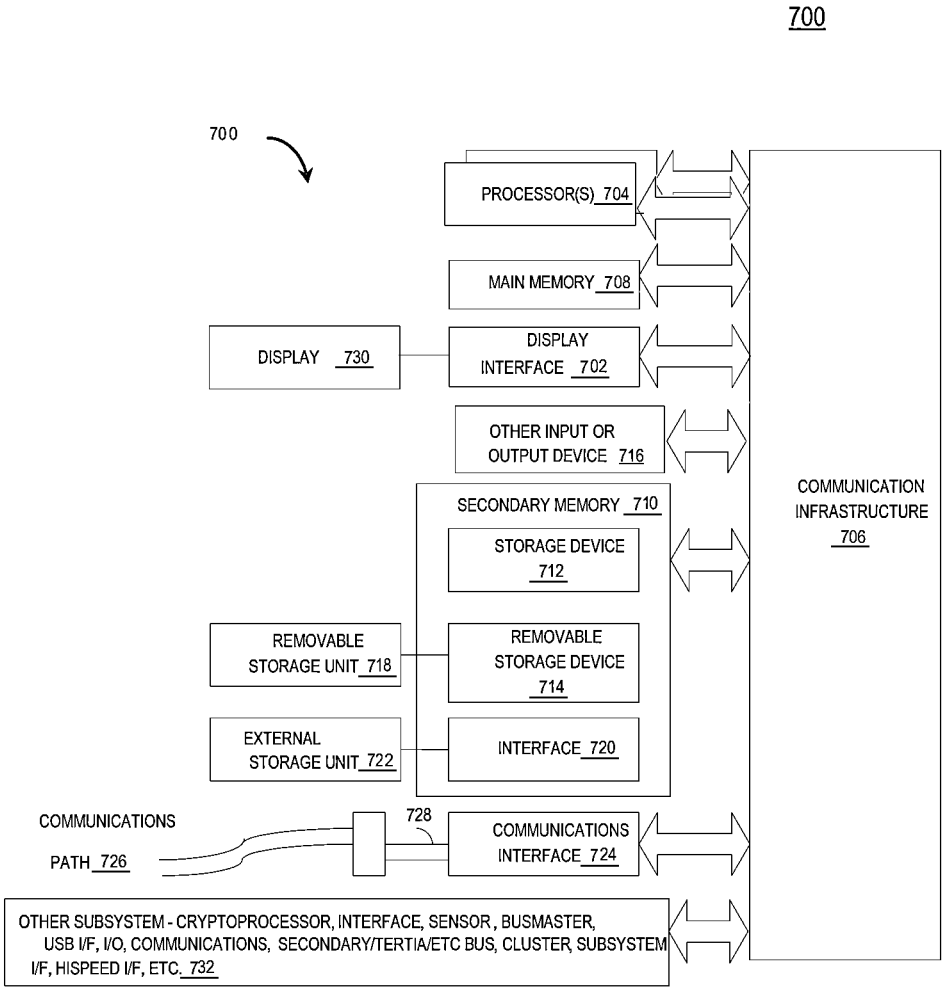
FIG. 7 depicts an illustration of an example computer system as may be used to perform an example electronic board game version of the game, according to an example embodiment.

FIG. 7 depicts an illustration 700 of an example computer system as may be used to perform an example electronic board game version of the game, according to an example embodiment.

An Exemplary Computer System Platform

FIG. 7 depicts an example block diagram 700, illustrating an example embodiment of an electronic computer processor-based device, which may be configured by special purpose game software to enable allowing players to play a game similar to any of the above games in a simulated and/or video game and/or computer based game and/or Internet browser application based game, and/or mobile phone such as smart phone based application (app) based game (iOS and/or Android, etc.), and/or an augmented reality and/or virtual reality based version of the game, which may include various enhanced two dimensional and/or three dimensional and/or more dimensional representations of game playing pieces, and may include use of gesture controls, voice commands and/or other computer related implemented simulations of gameplay, and may include various graphical user interface enhancements including scoring points, and/or leader boards, and/or tracing of history of scoring and/or points and/or bonus points, and/or may include an automated game play where a user may play against a computer based player and/or a remote massively multiplayer online game (MMOG) with other players in remote locations and/or via cell phones, computer devices and/or smartphones, and may include video display on external monitors and/or televisions and/or VR/AR devices for multiple user viewing of an example shared gaming environment. The user devices may be coupled to one another via an example electronic and/or optical communications data network such as, e.g., the global Internet using well known protocols such as, e.g., but not limited to, Transmission Control Protocol/Internet Protocol (TCP/IP), and hyper text markup language (HTML) among various other well known application servers and webservers coupled together via data networks and/or cloud based storage and/or processing and server resources which may include any of various routers, gateways, ethernet and/or other network interface card (NIC) devices, cabling, wiring and/or wireless coupling and/or connections, according to example embodiments. The present embodiments (or any part(s) or function(s) thereof) may be implemented using hardware, software, firmware, or a combination thereof and may be implemented in one or more computer systems or other processing systems. In fact, in one exemplary embodiment, the invention may be directed toward one or more computer systems capable of carrying out the functionality described herein. An example of a computer system 700 could be used as suggested by the figures, depicting an exemplary embodiment of a block diagram of an exemplary computer system useful for implementing the present invention. Specifically, an example computer 700, which in an exemplary embodiment may be, e.g., (but not limited to) a personal computer (PC) system running an operating system such as, e.g., (but not limited to) WINDOWS MOBILE™ for POCKET PC, or MICROSOFT® WINDOWS® NT/98/2000/XP/CE/, etc. available from MICROSOFT® Corporation of Redmond, WA, U.S.A., SOLARIS® from SUN® Microsystems of Santa Clara, CA, U.S.A., OS/2 from IBM® Corporation of Armonk, NY, U.S.A., MAC/OS, MAC/OSX, IOS, etc. from APPLE® Corporation of Cupertino, CA, U.S.A., etc., or any of various versions of UNIX® (a trademark of the Open Group of San Francisco, CA, USA) including, e.g., LINUX®, HPUX®, IBM AIX®, and SCO/UNIX®, etc. However, the invention may not be limited to these platforms. Indeed aspects of systems may include devices with various other input and/or output subsystems including, e.g., but not limited to, tablet displays, keyboards, various sensor(s), touch screen sensors, pressure sensors, location sensors (e.g., global positioning system (GPS), inertial measurement units (IMUs), accelerometers, proximity sensors, ultrasonic, touch, and/or other sensors, wearables, Internet of Things (ioT) devices, etc.), accelerometers, multi-dimensional sensor(s), temporal based datalogs, etc. Instead, the invention may be implemented on any appropriate computer system running any appropriate operating system. In one exemplary embodiment, the present invention may be implemented on a computer system operating as discussed herein. An exemplary computer system, computer 700. Other components of the invention, such as, e.g., (but not limited to) a computing device, a communications device, a telephone, a smartphone, a personal digital assistant (PDA), a personal computer (PC), a handheld PC, client workstations, thin clients, thick clients, proxy servers, network communication servers, remote access devices, client computers, server computers, peer-to-peer devices, tablets, touch-enabled devices, sensor enabled devices, location sensing devices, convertible, table/laptop, mobile, smart devices, smart phones, phablets, wearable technology, watch devices, glass devices, routers, web servers, data, media, audio, video, telephony or streaming technology servers, etc., may also be implemented using a computer and/or additional subsystems perhaps not all shown, as discussed.

The computer system 700 may include one or more processors, such as, e.g., but not limited to, processor(s) 704. The processor(s) 704 may be connected to a communication infrastructure 706 (e.g., but not limited to, a communications bus, cross-over bar, or network, etc.). Alternatively one or more subsystems can be built into an exemplary integrated circuit (IC), and/or application specific integrated circuits (ASICs), field programmable gate arrays (FPGAs), etc. Various exemplary software embodiments may be described in terms of this exemplary computer system. After reading this description, it will become apparent to a person skilled in the relevant art(s) how to implement the invention using other computer systems and/or architectures.

Computer system 700 may include a display interface 702 that may forward, e.g., but not limited to, graphics, text, and other data, etc., from the communication infrastructure 706 (or from a frame buffer, etc., not shown) for display on the display unit 730.

The computer system 700 may also include, e.g., but may not be limited to, a main memory 708, random access memory (RAM), and/or a secondary memory 710, etc. The secondary memory 710 may include, for example, (but not limited to) a hard disk drive 712, flash memory, a storage device, and/or a removable storage drive 714, representing a floppy diskette drive, a magnetic tape drive, an optical disk drive, a compact disk drive CD-ROM, DVD, BLU-RAY, etc. The removable storage drive 714 may, e.g., but not limited to, read from and/or write to a removable storage unit 718 in a well known manner. Removable storage unit 718, also called a program storage device or a computer program product, may represent, e.g., but not limited to, a floppy disk, magnetic tape, optical disk, compact disk, etc. which may be read from and written to by removable storage drive 714. As will be appreciated, the removable storage unit 718 may include a computer usable storage medium having stored therein computer software and/or data.

In alternative exemplary embodiments, secondary memory 710 may include other similar devices for allowing computer programs or other instructions to be loaded into computer system 700. Such devices may include, for example, a removable storage unit 722 and an interface 720. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, flash memory, SDRAM, USB memory device, DVD-ROM, CD-ROM, BLU-RAY, etc., and other removable storage units 722 and/or interfaces 720 which may allow software and data to be transferred from the removable storage unit 722 to computer system 700.

Computer 700 may also include an input device such as, e.g., (but not limited to) a mouse or other pointing device such as a digitizer, and a keyboard or other data entry device (none of which are labeled).

Computer 700 may also include output devices, such as, e.g., (but not limited to) display 730, touchscreen, passive, active, thin-film-transistor (TFT), passive touch, active touch, stylus enabled sensor based interface, flat panel, LCD, LED, and/or CRT, etc. and/or display interface 702, augmented reality (AR) glasses, virtual reality (VR) glasses, advanced heads up displays (HUDs), NTSC, HD, Ultra highdefinition, 4K, 8K, 16K, 32K, etc., and beyond resolution monitors, television, etc. Computer 700 may include input/output (I/O) devices such as, e.g., (but not limited to) communications interface 724, cable 728 and communications path 726, etc. These devices may include, e.g., but not limited to, a network interface card, and modems (neither are labeled). Communications interface 724 may allow software and data to be transferred between computer system 700 and external devices. Examples of communications interface 724 may include, e.g., but may not be limited to, a modem, a network interface (such as, e.g., an Ethernet card), a communications port, a Personal Computer Memory Card International Association (PCMCIA) slot and card, Universal Serial Bus, Busmaster interface, PCI bus, interface bus, card slot, and/or other interface, firewire, USB 1, 2, 3, . . . n, A, B, C, D, . . . x, including any comparable interface released in the future, from a standards body, or the like, etc. Software and data transferred via communications interface 724 may be in the form of signals 728 which may be electronic, electromagnetic, optical or other signals capable of being received by communications interface 724. These signals 728 may be provided to communications interface 724 via, e.g., but not limited to, a communications path 726 (e.g., but not limited to, a channel). This channel 726 may carry signals 728, which may include, e.g., but not limited to, propagated signals, and may be implemented using, e.g., but not limited to, wire or cable, fiber optics, a telephone line, a cellular link, a radio frequency (RF) link and other communications channels, etc.

In this document, the terms "computer program medium" and "computer readable medium" may be used to generally refer to media such as, e.g., but not limited to removable storage drive 714, a hard disk installed in hard disk drive 712, and signals 728, etc. These computer program products may provide software to computer system 700. The invention may be directed to such computer program products.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

Embodiments of the present invention may include apparatuses for performing the operations herein. An apparatus may be specially constructed for the desired purposes, or it may comprise a general purpose device selectively activated or reconfigured by a program stored in the device, and/or a special purpose device programmed according to various algorithms and/or flowcharts and processes/methods as described at length herein.

Embodiments of the invention may be implemented in one or a combination of hardware, firmware, and software. Embodiments of the invention may also be implemented as instructions stored on a machine-readable medium, which may be read and executed by a computing platform, which may include one or more processors, such as, e.g., but not limited to, a microprocessor, a multi-core processor, a quad-core processor, a central processing unit (CPU), a quantum computer, a nanoprocessor, a computational engine, an information appliance, a virtual processor, a co-processor, a busmaster processor, a graphics processor (GPU), a digital signal processor (DSP), and/or other processor, to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical, magneto-optical, SD-RAM, SDCard, and/or other form of non-transitory medium storing any propagated signals (e.g., carrier waves, infrared signals, digital signals, etc.), and others.

Computer programs (also called computer control logic), may include object oriented computer programs, and may be stored in main memory 708 and/or the secondary memory 710 and/or removable storage units 714, also called computer program products. Such computer programs, when executed, may enable the computer system 700 to perform the features of the present invention as discussed herein. In particular, the computer programs, when executed, may enable the processor 704 to provide a method to resolve conflicts during data synchronization according to an exemplary embodiment of the present invention. Accordingly, such computer programs may represent controllers of the computer system 700.

In another exemplary embodiment, the invention may be directed to a computer program product comprising a computer readable medium having control logic (computer software) stored therein. The control logic, when executed by the processor 704, may cause the processor 704 to perform the functions of the invention as described herein. In another exemplary embodiment where the invention may be implemented using software, the software may be stored in a computer program product and loaded into computer system 700 using, e.g., but not limited to, removable storage drive 714, hard drive 712 or communications interface 724, etc. The control logic (software), when executed by the processor 704, may cause the processor 704 to perform the functions of the invention as described herein. The computer software may run as a standalone software application program running atop an operating system, or may be integrated into the operating system.

In yet another embodiment, the invention may be implemented primarily in hardware using, for example, but not limited to, hardware components such as application specific integrated circuits (ASICs), or one or more state machines, etc. Implementation of the hardware state machine so as to perform the functions described herein will be apparent to persons skilled in the relevant art(s).

In another exemplary embodiment, the invention may be implemented primarily in firmware.

In yet another exemplary embodiment, the invention may be implemented using a combination of any of, e.g., but not limited to, hardware, firmware, and software, etc.

Exemplary embodiments of the invention may also be implemented as instructions stored on a machine-readable medium, which may be read and executed by a computing platform to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or nontransitory versions of other forms of previously propagated signals (e.g., carrier waves, infrared signals, digital signals, etc.), and others.

Still referring to the figures, a universal integrated circuit card (UICC) (not shown) comprising a subscriber identity module and possibly a secure storage and/or cryptoprocessor can also coupled to the application or system processor. The system may further include a security processor (not shown) that may couple to the application or system processor or CPU.

One or more, or a plurality of sensors may couple to processor, or application processor to enable input of a variety of sensed information such as accelerometer and other environmental information. An audio, and/or video, output device may provide an interface to output sound, and/or other data, e.g., in the form of voice communications, played or streaming audio data and so forth.

As further illustration of the figures, an exemplary near field communication (NFC) contactless interface can be provided in certain embodiments, that can communicate in a NFC near field via an NFC antenna, for example (not shown). While separate antennae can be used, not all are shown in figures for simplicity of illustration, but will be apparent to those skilled in the relevant art, understand that in some implementations can include one or more antenna (ac) or a different set of antennae may be provided to enable various wireless functionality.

Further, an exemplary power management integrated circuit (PMIC) can couple to application processor, or system processor, to perform platform level power management. To this end, PMIC (not shown) may issue power management requests to application processor, system processor, etc., to enter certain low power states as desired. Furthermore, based on platform constraints, PMIC may also control the power level of other components of the exemplary system as shown in figures. To enable communications to be transmitted and received, various circuitry may be coupled between an exemplary baseband or other system processor and/or an antenna (not necessarily shown in the block diagram). Specifically, a radio frequency (RF) transceiver and/or a wireless local area network (WLAN) transceiver, and/or a network interface card (NIC) may be present, in certain exemplary embodiments. In general, RF transceivers may be used to receive and transmit wireless data and calls according to a given wireless communication protocol such as, e.g., but not limited to, 3G, 4G, 5G, nG, next generation (NG), etc. wireless communication protocol such as in accordance with a code division multiple access (CDMA), global system for mobile communication (GSM), long term evolution (LTE) or other protocol. In addition a GPS sensor may be present in certain embodiments (not necessarily shown in block diagram). Other wireless and/or wired communications such as, e.g., but not limited to, receipt or transmission of radio signals, e.g., AM/FM, Wi-Fi, WiMAX, etc., and other signals may also be provided, on a local area, and/or a wide area basis. In addition, via an exemplary WLAN transceiver, local wireless communications can also be realized.

Further referring to the figures, shown is a block diagram of another example system with which embodiments may be used. In the illustration of exemplary systems herein, some communications devices may be mobile, and/or portable, and/or, low-power system(s) such as, e.g., but not limited to, a tablet computer, 2:1 tablet, phablet, a smartphone, a laptop, a notebook, a portable computer, a personal computer, a telephony device, a cellphone, an ultrabook, a GOOGLE CHROME book, etc, a thick client, a fat client, a thin client, and/or convertible and/or standalone, and/or desktop and/or tablet system. As illustrated, a system on a chip (SoC) can also be used and may be configured to operate as a system processor, and/or an application processor for the device.

A variety of devices may couple to an exemplary SoC. In the illustration shown, a memory subsystem may include an exemplary flash memory and/or a DRAM coupled to a SoC, and/or processor and/or controller, and/or microcontroller. In addition, a touch panel 1320 is coupled to the SoC, etc. to provide display capability and/or user input via exemplary touch and/or other interface, including, e.g., but not limited to, provision of an actual, and/or virtual keyboard, and/or other input device, which can be alternatively displayed on an exemplary display of an exemplary touch enabled display panel monitor, or other output device or screen, according to exemplary embodiments.

To provide wired network connectivity, SoC or system processor can couple to an exemplary network interface such as, e.g., but not limited to, an exemplary Ethernet interface. A peripheral hub can be coupled to SoC or system processor, in some embodiments, to enable interfacing with various peripheral devices, such as may be coupled to system by any of various ports and/or other connectors. Various other output devices can include any of various indicators such as, e.g., but not limited to, display interfaces, LEDs, LCDs, etc., interfaces, command line interfaces, graphical user interfaces, etc.

In addition to internal power management circuitry and functionality optionally provided in some embodiments, within SoC or system processor, or a PMIC can be coupled to exemplary SoC or system processor embodiments to provide exemplary platform-based power management, e.g., based on whether the system is powered by a battery, or AC power, via an AC adapter, and/or uninterruptible power supply or other power source, in an exemplary embodiment. In addition to this power source-based power management, PMIC may further perform platform power management activities based on environmental and usage conditions in some embodiments. Still further, PMIC may communicate control and status information to SoC or system processor or controller to cause various power management actions within SoC or system processor, in exemplary embodiments.

Still referring to the figures, to provide for exemplary communication functions, such as, e.g., but not limited to, wired capabilities, and/or wireless capabilities, a communication interface, such as, e.g., a WLAN unit can be coupled to SoC or system processor and/or in turn to an exemplary antenna. In various implementations, WLAN unit or other communications devices may provide for communication according to one or more wireless and/or wired communications protocols, as described herein, and as would be apparent to those skilled in the relevant art.

In illustrative embodiments, a plurality of sensors (not shown) may couple to SoC and/or the system processor. These sensor(s) may include, e.g., but not limited to, various accelerometer, environmental and other sensors, including, e.g., but not limited to, user gesture sensors, range finders, location based sensors, gyroscopic, pressure, flow, laser, electronic, optical, light based, displacement, radar, lidar, temperature, touch, ultrasonic, and/or other well known sensors, etc., Finally, an audio codec, and/or an analog to digital converter, and/or digital to analog converter, can be coupled to SoC or system processor to provide an interface to an exemplary audio input and/or output device. Of course, as will be understood to those skilled in the relevant art, such examples are intended merely as way of example, but not limitation, and that whether shown or not shown, discussed, or not discussed, are intended still to potentially fall with this particular implementations as described in the exemplary figures, however many variations and alternatives are possible within the scope of the claims as set forth below.

The exemplary embodiment of the present invention makes reference to wired, or wireless networks. Wired networks include any of a wide variety of well known ways for coupling voice and data communications devices together. A brief discussion of various exemplary wireless network technologies that may be used to implement the embodiments of the present invention now are discussed. The examples are non-limited. Exemplary wireless network types may include, e.g., but not limited to, code division multiple access (CDMA), spread spectrum wireless, orthogonal frequency division multiplexing (OFDM), 1G, 2G, 3G, 4G, 5G, 6G, n-G (any future wireless standard), next generation (NG), wireless, Bluetooth, Infrared Data Association (IrDA), shared wireless access protocol (SWAP), "wireless fidelity" (Wi-Fi), WIMAX, and other IEEE standard 802.11-compliant wireless local area network (LAN), 802.16-compliant wide area network (WAN), and ultrawideband (UWB), etc.

Bluetooth is a wireless technology promising to unify several wireless technologies for use in low power radio frequency (RF) networks.

IrDA is a standard method for devices to communicate using infrared light pulses, as promulgated by the Infrared Data Association from which the standard gets its name. Since IrDA devices use infrared light, they may depend on being in line of sight with each other.

The exemplary embodiments of the present invention may make reference to WLANs. Examples of a WLAN may include a shared wireless access protocol (SWAP) developed by Home radio frequency (HomeRF), and wireless fidelity (Wi-Fi), a derivative of IEEE 802.11, advocated by the wireless Ethernet compatibility alliance (WECA). The IEEE 802.11 wireless LAN standard refers to various technologies that adhere to one or more of various wireless LAN standards. An IEEE 802.11 compliant wireless LAN may comply with any of one or more of the various IEEE 802.11 wireless LAN standards including, e.g., but not limited to, wireless LANs compliant with IEEE std. 802.11a, b, d, g, n, etc. such as, e.g., but not limited to, IEEE std. 802.11 a, b, d, g, n, (including, e.g., but not limited to IEEE 802.11g-2003, etc.), IEEE 802.16, Wi-MAX, etc.

Wide area networks (WANs) allow extending of computer networks over large distances, connecting or coupling remote branch offices to data centers and to other branch offices, and delivery of applications and services required to perform business functions. When entities like companies or government agencies extend networks over greater distances and sometimes across multiple carriers; networks, the entities can face operational challenges including, e.g., but not limited to, latency, network congestion, jitter, packet loss, and/or even service outages, etc. Modern communications related applications such as, e.g., but not limited to, voice over internet protocol (VOIP) calling, videoconferencing, streaming media, and/or virtualized applications and/or desktops, etc., can require low latency. Bandwidth requirements are also continually increasing, especially for applications featuring high-definition video, and the like. Expanding WAN capability can be expensive and difficult with corresponding difficulties related to network management and troubleshooting.

Certain example embodiments may include further improvements, such as, e.g., but not limited to, where alternative components may be included including, e.g., integrated artificial intelligence/machine learning based embodiments which may include AI game play with an automated autonomous player which may be implemented via various programming techniques as will be apparent to those skilled in the relevant art, and may include expert system subsystems, neural networks, generative pre-trained AI/ML systems which may be trained using game rules data to be able to perform using a large language learning (LLM) data model which may be trained with example game rules to play the programmed game, which is set up to allow for random number generation for play pieces, and/or use of programmed random values for game placed play, such as, e.g., but not limited to, placement of random position of a indicia of a game piece like an icon of a ball 13 on a simulated game board of an image or 3D rendering representation of a gameboard showing game play and potentially also illustrating via GUI elements scores of players, teams, users, players, etc. as well as game piece values, operations, mathematical operands, and/or other alphanumeric representations of values for game positions in a simulated surface tray 10, and/or graphical representations of cavities and/or non cavity portions of the simulated surface game board, etc. The computer system as represented herein may include other functionality as is well known including, e.g., but not limited to, audio and/or video, text and/or other images or content, e.g., that may appear in books, music, movies, videos, computer games, 3D visualizations, holograms, and/or virtual reality and augmented reality experiences, among other things. Certain embodiments may make use of artificial intelligence, machine learning, large AI databases, OpenAI, ChatGPT, other AI systems, expert systems, neural networks, executive information systems, decision support systems, natural language search, voice recognition, speech recognition, etc. Similarly, the systems and devices may be of various different form factors and can also take a variety of different forms. For example, computing devices may include, e.g., but not limited to, computers, mobile devices, handheld devices, portable computers, servers, clients, workstations, desktops, notebooks, laptops, digital eBook readers, tablets, phablets, computers, personal computers, handheld devices, phones, mobile phones, smart phones, wearables, smart watches, glasses, neural chips, monitors, televisions and/or projection devices, etc. Such devices may also include, e.g., but not limited to wearable interactive devices, such as, e.g., but not limited to, holographic glasses, augmented reality goggles, mixed reality devices, internet contact lenses, and virtual reality headsets, etc., embedded devices, devices coupled to one's person, prosthetics, internal and external systems, interfaced systems, etc. These devices may contain electronic computer processors, systems on a chip, embedded processors, microcontrollers, FPGAs, ASICS, ICs, VLSI, and electronic computer memory storage devices, memory devices, FLASH devices, etc., configured to process and/or store data, machine learned data, user preferences, user history, content, aggregated data and artificial intelligence algorithms, among other things. The devices may contain one or more electronic sensors, or may be used in combination or alone, as a sensor, an electronic sensor, an electromechanical sensor, as well as with other devices including optical devices, electronic devices, magneto-optical devices, optical fiber communications systems, wired communications systems, wireless communication systems, etc., as well as other sensors such as, e.g., but not limited to, cameras, microphones, accelerometers, gyroscopes, pressure and temperature sensors, magnetometers, global positioning systems, audio level detection, light detection and ranging (LIDAR), laser, radio, and ambient light sensors, proximity, distance, intrusion detection, access control systems, etc. The sensors may also include or may be integrated with, or coupled to, e.g., but not limited to, barometers, humidity and proximity sensors, touch sensors, fluid sensors, external surface sensors, fingerprint sensors, activity sensors, health sensors, accelerometer, inertial measurement units, altimeter, altitude measurement subsystems, height/depth, and other sensing units, ultrasonic and rangefinder, as well as other well known sensors, etc. Such devices can be connected to a communications network, such as, e.g., but not limited to, voice, data, cable, wired or wireless, public or private, intranet or internet, the Global Internet, cellular, satellite, bus or star topologies, local area, personal area, or wide area, wireless communications networks including, e.g., but not limited to, Wi-Fi, 1G-4G, 5G, nG, Starlink, WiMax, point-to-point, point-to-multipoint, short distance, BLUETOOTH, personal area networks, routers, gateways, etc., configured to communicate with other exemplary systems and devices, etc.

According to certain example embodiments, gameplay may be simulated by an artificial intelligence player, using any of various well known artificial intelligence (AI) and machine learning (ML) technologies including, e.g., but not limited to, neural networks, expert systems, convolutional neural networks, generative AI, generative pre-trained AI/ML large language models, unsupervised, supervised, or other type of AI.

Finally, Applicant respectfully notes that when Applicant refers to a player or user, generally, Applicant is referring to either the board game and related game pieces, or to one or more of the electronic, mobile computer processor enabled user device such as, e.g., but not limited to, a personal computer and/or a mobile smartphone including an electronic computer processor and a plurality of related subcomponents including input devices, output devices, communications interfaces and devices (wired and/or wireless), as well as memory, onboard, cache, external, integrated, and/or removable, as well as any of various electronic data network components as will be understood to be implied to those having relevant skill in the art, according to various example embodiments.

While various embodiments of the present invention have been described above, it should be understood that they have been presented by way of example only, and not limitation. Thus, the breadth and scope of the present invention should not be limited by any of the above-described example or exemplary embodiments, but should instead be defined only in accordance with the following claims and their equivalents. Although the invention is described in terms of the exemplary embodiments, it is important to note that the description in these terms is provided for purposes of illustration only. It is not intended that the invention be limited to these example environments or to the precise interaction between the different elements of the invention. In fact, after reading the following descriptions it will become apparent to a person skilled in the relevant art how to implement the invention in alternative environments.

What is claimed is:

1. A multi-player or multigroup-player board game apparatus comprising:

a frame with a base configured to enable players to choose a surface tray from a plurality of surface trays to place inside the frame with the base and to replace an existing surface tray with another surface tray inside the frame with the base, wherein the existing surface tray or the another surface tray comprise:

a plurality of cavity areas and non-cavity areas, wherein a number of cavity areas of said plurality of the cavity areas is greater than a number of the non-cavity areas and the non-cavity areas comprise at least one raised section in between or adjacent the plurality of cavity areas, the plurality of the cavity areas are disposed on the existing or the another surface tray, arranged in a matrix form, and have uniform shapes, wherein each of the plurality of surface trays having the plurality of cavities and inside of some of these cavities a number value and a mathematical equation or mathematical operation is indicated, wherein the board game is configured to receive a light bouncy ball having a size similar to the size of the cavity area, when projected onto one of the plurality of the surface trays in order to land in a cavity of the one of the plurality of surface trays, and wherein the cavity is configured to hold the light bouncy ball; and wherein some of the cavity areas where the ball is expected to more frequently fall inside are blank.

2. The multiplayer or multigroup-player board game of claim 1, wherein at least one fully blank surface tray is provided wherein the at least one fully blank surface tray is configured to allow the players to write number values, mathematical equations, mathematical operations, or any other game rules on the bottom of the cavities to customize the game of the players.

3. The multiplayer or multigroup-player board game of claim 1, wherein the players choose from at least three different playing options.

4. The multiplayer or multigroup-player board game of claim 1, wherein a first playing option is each player or group of players has a certain number of throws and the players start in a turn by turn basis, a player throws the ball by bouncing off the ball off a primary surface outside of the surface tray and the ball lands in a cavity, the player then adds/subtracts/divides/multiplies or does any other mathematical equation or mathematical operation mentioned in the cavity including doing nothing when the cavity is blank and adds an earned score to a sum of previously earned scores; then the player counts a remaining number of throws and while the number of throws is less than the certain number of throws the players keep on playing and the game goes back to throwing the balls onto the surface tray; and once the player's number of throws is finished, the earned scores of each player are added up and compared with other player's earned score and the player with the highest earned score wins.

5. The multiplayer or multigroup-player board game of claim 1, wherein a second playing option is when the players or group of players reach or exceed a predetermined score, in this game play the players or groups of players start in a turn by turn basis, players throw the ball by bouncing the ball off a primary surface outside of the surface tray or directly into the surface tray and the ball lands in a cavity; the player then adds/subtracts/divides/multiplies or does any other mathematical equation mentioned in the cavity and adds earned score to a sum of previously earned score; then the player counts the earned score and while the earned score is less than a predetermined score the players keep on playing and the game goes back to throwing the balls onto the surface tray; and once one of the players or group of players reaches or exceeds the predetermined score, the game ends and the player who met or exceeded the predetermined score first wins the game.

6. The multiplayer or multigroup-player board game of claim 1, wherein a third playing option is to agree on a score and the players or group of players have to be as close as possible to that score without going over that score; In this game play the players or group of players start in a turn by turn basis, a player throws the ball by bounding off a ball off a primary surface outside of the surface tray or throw the ball directly into the cavities and the ball lands in a cavity, the player(s) then adds/subtracts/divides/multiplies or does any other mathematical equation mentioned in the cavity and adds earned score to a sum of previously earned scores; then the player counts the earned score and while the earned score is less than the agreed upon score the player has to decide if the player or group of players want to keep on playing or want to stop; when the player decides to play one more round, the game goes back and the player throws the ball and adds the earned score where the ball landed in the cavity; when a total earned score is more than the agreed upon score the player who exceeded the agreed upon score loses the game and is eliminated; when the total earned score is still less than the agreed upon score the player has to decide to throw one more ball or stop; when the player decides to throw one more ball the game is repeated; when the player decides to stop, the player waits for other players or group of players to stop and the earned scores for players who did not go over the agreed upon score are compared and the player with closest score to the agreed upon score is considered the winner.

7. The multiplayer or multigroup-player board game of claim 1, wherein the players may also choose light bouncy balls with cavities or grooves or any other irregular cavities on them in order to make landing of the balls inside the surface tray more unpredictable and earn more score.

8. The multiplayer or multigroup-player board game of claim 7, these light bouncy balls with cavities or grooves may have multi-score points and landing one of these balls inside a cavity of the surface tray can multiply the number value inside the cavity of the surface tray by the ball's multi-score points; the player can lose a turn because the light bouncy balls with cavities or grooves might not land inside the surface tray and the player loses a turn.

9. The multiplayer or multigroup-player board game of claim 1, wherein the surface trays can be selected from predetermined surface trays having preassigned number values and mathematical equations written on the bottom of the cavities, a blank surface tray may be selected where the players can write their own number values, mathematical equations, and text so when the ball falls inside the cavity with text, the players have to follow or perform the text.

10. The multiplayer or multigroup-player board game of claim 1, wherein each of the plurality of surface trays have preassigned number values, mathematical equations and blank spaces that are designed for different skill players.

11. The multiplayer or multigroup-player board game of claim 1, wherein when a ball lands inside a cavity with mathematical equation or mathematical operation or mathematical function, the mathematical equation or the mathematical operation or the mathematical function is applied to the sum of previously earned scores.

12. The multiplayer or multigroup-player board game of claim 1, further comprising at least one or more of: a) wherein a first playing option is each player or group of players has a certain number of throws and the players start in a turn by turn basis, a player throws the ball by bouncing off the ball off a primary surface outside of the surface tray and the ball lands in a cavity, the player then adds/subtracts/divides/multiplies or does any other mathematical equation or mathematical operation mentioned in the cavity including doing nothing when the cavity is blank and adds an earned score to a sum of previously earned scores; then the player counts a remaining number of throws and while the number of throws is less than the certain number of throws the players keep on playing and the game goes back to throwing the balls onto the surface tray; and once the player's number of throws is finished, the earned scores of each player are added up and compared with other player's earned score and the player with the highest earned score wins; b) wherein a second playing option is when the players or group of players reach or exceed a predetermined score, in this game play the players or groups of players start in a turn by turn basis, players throw the ball by bouncing the ball off a primary surface outside of the surface tray or directly into the surface tray and the ball lands in a cavity; the player then adds/subtracts/divides/multiplies or does any other mathematical equation mentioned in the cavity and adds earned score to a sum of previously earned score; then the player counts the earned score and while the earned score is less than a predetermined score the players keep on playing and the game goes back to throwing the balls onto the surface tray; and once one of the players or group of players reaches or exceeds the predetermined score, the game ends and the player who met or exceeded the predetermined score first wins the game; or c) wherein a third playing option is to agree on a score and the players or group of players have to be as close as possible to that score without going over that score; In this game play the players or group of players start in a turn by turn basis, a player throws the ball by bounding off a ball off a primary surface outside of the surface tray or throw the ball directly into the cavities and the ball lands in a cavity, the player(s) then adds/subtracts/divides/multiplies or does any other mathematical equation mentioned in the cavity and adds earned score to a sum of previously earned scores; then the player counts the earned score and while the earned score is less than the agreed upon score the player has to decide if the player or group of players want to keep on playing or want to stop; when the player decides to play one more round, the game goes back and the player throws the ball and adds the earned score where the ball landed in the cavity; when a total earned score is more than the agreed upon score the player who exceeded the agreed upon score loses the game and is eliminated; when the total earned score is still less than the agreed upon score the player has to decide to throw one more ball or stop; When the player decides to throw one more ball the game is repeated; when the player decides to stop, the player waits for other players or group of players to stop and the earned scores for players who did not go over the agreed upon score are compared and the player with closest score to the agreed upon score is considered the winner.

13. The multiplayer or multigroup-player board game of claim 1, wherein the board game is simulated in a computer-based game, wherein the board game comprises a set of instructions embodied on a computer accessible storage medium which when executed on an electronic computer processor, performs the simulated steps described.

14. The multiplayer or multigroup-player board game of claim 13, wherein the board game is configured to allow users or players to play other users remotely or to play automated users.

15. A computer implemented multi-player or multigroup-player board video game method comprising:

electronically simulating, on at least one electronic computer processor, a frame electronic representation with a base electronic representation configured to enable players to electronically choose a surface tray electronic representation from a plurality of surface tray electronic representations to electronically display being placed inside the frame electronic representation with the base electronic representation and to electronically replace an existing surface tray electronic representation with another surface tray electronic representation inside the frame electronic representation with the base electronic representation, wherein the existing surface tray electronic representation or the another surface tray electronic representation comprise:

a plurality of cavity area electronic representations and non-cavity area electronic representations, wherein a number of cavity area electronic representations of said plurality of the cavity area electronic representations is greater than a number of the non-cavity area electronic representations and the non-cavity area electronic representations comprise at least one raised section electronic representation in between or adjacent the plurality of cavity area electronic representations, the plurality of the cavity area electronic representations are disposed on the existing or the another surface tray electronic representation, arranged in a matrix electronic representation form, and have uniform electronic representation shapes, wherein each of the plurality of surface tray electronic representation s having the plurality of cavity area electronic representations and inside of some of these cavity area electronic representations a number value and a mathematical equation or mathematical operation is indicated, wherein the board video game is configured to receive a light bouncy ball electronic representation having an electronic representation size similar to the electronic representation size of the cavity area electronic representation, when projected onto one of the plurality of the surface tray electronic representations in order to electronically represent landing in a cavity area electronic representation of the one of the plurality of surface tray electronic representations, and wherein the cavity area electronic representation is configured to electronically represent holding the light bouncy ball electronic representation; and wherein some of the cavity area electronic representations where the light bouncy ball electronic representation is expected to more frequently fall inside are blank electronic representations.

16. A nontransitory computer program product embodied on a computer accessible storage medium comprising a plurality of computer readable instructions, which when executed on an electronic computer processor is configured to perform a multi-player or multigroup-player board video game method comprising:

electronically simulating, on at least one electronic computer processor, a frame electronic representation with a base electronic representation configured to enable players to electronically choose a surface tray electronic representation from a plurality of surface tray electronic representations to electronically display being placed inside the frame electronic representation with the base electronic representation and to electronically replace an existing surface tray electronic representation with another surface tray electronic representation inside the frame electronic representation with the base electronic representation, wherein the existing surface tray electronic representation or the another surface tray electronic representation comprise:

a plurality of cavity area electronic representations and non-cavity area electronic representations, wherein a number of cavity area electronic representations of said plurality of the cavity area electronic representations is greater than a number of the non-cavity area electronic representations and the non-cavity area electronic representations comprise at least one raised section electronic representation in between or adjacent the plurality of cavity area electronic representations, the plurality of the cavity area electronic representations are disposed on the existing or the another surface tray electronic representation, arranged in a matrix electronic representation form, and have uniform electronic representation shapes, wherein each of the plurality of surface tray electronic representation s having the plurality of cavity area electronic representations and inside of some of these cavity area electronic representations a number value and a mathematical equation or mathematical operation is indicated, wherein the board video game is configured to receive a light bouncy ball electronic representation having an electronic representation size similar to the electronic representation size of the cavity area electronic representation, when projected onto one of the plurality of the surface tray electronic representations in order to electronically represent landing in a cavity area electronic representation of the one of the plurality of surface tray electronic representations, and wherein the cavity area electronic representation is configured to electronically represent holding the light bouncy ball electronic representation; and wherein some of the cavity area electronic representations where the light bouncy ball electronic representation is expected to more frequently fall inside are blank electronic representations.

17. The apparatus according to claim 1, further comprising a computer system of providing a multi-player or multigroup-player board video game, the computer system further comprising:

at least one electronic computer processor of a board video game hosting service provider; and at least one electronic memory coupled to said at least one electronic computer processor, wherein said at least one electronic computer processor is configured to:

electronically simulate a frame electronic representation with a base electronic representation configured to enable players to electronically choose a surface tray electronic representation from a plurality of surface tray electronic representations to electronically display being placed inside the frame electronic representation with the base electronic representation and to electronically replace an existing surface tray electronic representation with another surface tray electronic representation inside the frame electronic representation with the base electronic representation, wherein the existing surface tray electronic representation or the another surface tray electronic representation comprise:

a plurality of cavity area electronic representations and non-cavity area electronic representations, wherein a number of cavity area electronic representations of said plurality of the cavity area electronic representations is greater than a number of the non-cavity area electronic representations and the non-cavity area electronic representations comprise at least one raised section electronic representation in between or adjacent the plurality of cavity area electronic representations, the plurality of the cavity area electronic representations are disposed on the existing or the another surface tray electronic representation, arranged in a matrix electronic representation form, and have uniform electronic representation shapes, wherein each of the plurality of surface tray electronic representations having the plurality of cavity area electronic representations and inside of some of these cavity area electronic representations a number value and a mathematical equation or mathematical operation is indicated, wherein the board video game is configured to receive a light bouncy ball electronic representation having an electronic representation size similar to the electronic representation size of the cavity area electronic representation, when projected onto one of the plurality of the surface tray electronic representations in order to electronically represent landing in a cavity area electronic representation of the one of the plurality of surface tray electronic representations, and wherein the cavity area electronic representation is configured to electronically represent holding the light bouncy ball electronic representation; and wherein some of the cavity area electronic representations where the light bouncy ball electronic representation is expected to more frequently fall inside are blank electronic representations.

18. The apparatus and system of claim 17, further comprising:

a data communications network, electronically coupled to said at least one electronic computer processor of said board video game hosting service provider;

a plurality of electronic user devices coupled to said data communications network via at least one or more of a web-browser based web application or a mobile device app; and an application server coupled to said data communications network, configured to enable remote multiplayer play of the multi-player or multigroup-player board video game.

19. The apparatus and system of claim 18, wherein said application server coupled to said data communications network, configured to enable remote multiplayer play of the multi-player or multigroup-player board video game comprises at least one artificial intelligence or machine learning based simulated player with which a user may interact by natural language processing search, voice recognition, and text to speech generation.

20. The apparatus and system of claim 19, comprising at least one or more of a generative pre-trained large language model, a neural network, or a convolutional neural network.

* * * * *